US008382278B2

(12) United States Patent
Silverbrook

(10) Patent No.: US 8,382,278 B2
(45) **Date of Patent: *Feb. 26, 2013**

(54) CAPPING DEVICE FOR HAND-HELD PRINTER

(75) Inventor: Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/280,322

(22) Filed: Oct. 24, 2011

(65) Prior Publication Data

US 2012/0038729 A1 Feb. 16, 2012

Related U.S. Application Data

(63) Continuation of application No. 12/478,731, filed on Jun. 4, 2009, now Pat. No. 8,042,934, which is a continuation of application No. 11/583,870, filed on Oct. 20, 2006, now Pat. No. 7,556,371, which is a continuation of application No. 10/503,887, filed on Aug. 9, 2004, now Pat. No. 7,144,107.

(30) Foreign Application Priority Data

Feb. 13, 2002 (AU) ..... PS0485

(51) Int. Cl.
*B41J 3/36* (2006.01)
*B41J 2/165* (2006.01)

(52) U.S. Cl. ..... 347/109; 347/29; 347/32

(58) Field of Classification Search ..... None
See application file for complete search history.

(56) References Cited

U.S. PATENT DOCUMENTS

| | | | |
|---|---|---|---|
| 5,306,908 | A | 4/1994 | McConica et al. |
| 5,627,571 | A | 5/1997 | Anderson et al. |
| 5,663,751 | A | 9/1997 | Holbrook |
| 5,677,715 | A | 10/1997 | Beck et al. |
| 5,825,995 | A | 10/1998 | Wiklof et al. |
| 5,853,251 | A | 12/1998 | Imai |
| 5,887,992 | A | 3/1999 | Yamamashi |

(Continued)

FOREIGN PATENT DOCUMENTS

| | | |
|---|---|---|
| EP | 410691 B1 | 9/1994 |
| JP | 63-069654 | 3/1988 |

(Continued)

*Primary Examiner* — Stephen Meier
*Assistant Examiner* — Leonard S Liang

(57) ABSTRACT

A handheld inkjet printer is disclosed. The printer has a housing, a printhead fixedly mounted in the housing, and a capping device mounted external to the housing. The capping device has an arm, a capping leg extending transversely from the arm and an elastomeric pad affixed to the capping leg and in capping engagement with the printhead. The arm has a resilient portion deformable towards the housing upon receipt of a force. The housing defines a fulcrum with the arm and the leg being positioned on opposite sides of the fulcrum. Deformation of the arm towards the housing causes displacement of the capping leg, which in turn causes the elastomeric pad to move out of capping engagement with the printhead.

4 Claims, 5 Drawing Sheets

U.S. PATENT DOCUMENTS

| | | | | |
|---|---|---|---|---|
| 5,953,497 | A | 9/1999 | Kokubo et al. | |
| 5,988,900 | A | 11/1999 | Bobry | |
| 6,015,211 | A | 1/2000 | Kinoshita et al. | |
| 6,062,686 | A | 5/2000 | Kinoshita et al. | |
| 6,095,634 | A | 8/2000 | Kishi | |
| 6,151,043 | A | 11/2000 | Michael et al. | |
| 6,270,182 | B1 | 8/2001 | Silverbrook | |
| 6,450,605 | B1 | 9/2002 | Walmsley et al. | |
| 6,543,892 | B2 | 4/2003 | Kubota et al. | |
| 6,702,424 | B2 | 3/2004 | Takahashi | |
| 6,793,318 | B2 | 9/2004 | Saksa | |
| 7,284,845 | B2 | 10/2007 | Berry et al. | |
| 7,341,328 | B2 | 3/2008 | Berry et al. | |
| 7,404,617 | B2 | 7/2008 | Silverbrook et al. | |
| 7,556,371 | B2 | 7/2009 | Silverbrook | |
| 8,042,934 | B2 * | 10/2011 | Silverbrook | 347/109 |
| 2002/0080208 | A1 | 6/2002 | Miyauchi et al. | |
| 2002/0083218 | A1 | 6/2002 | Barrett | |
| 2003/0020779 | A1 | 1/2003 | Takahashi | |
| 2003/0174241 | A1 | 9/2003 | Silverbrook | |
| 2006/0023019 | A1 | 2/2006 | Silverbrook | |

FOREIGN PATENT DOCUMENTS

| | | | |
|---|---|---|---|
| JP | 63-274552 | | 11/1988 |
| JP | 63-274553 | | 11/1988 |
| JP | 63274552 | | 11/1988 |
| JP | 02-016056 | A | 1/1990 |
| JP | 04-151255 | | 5/1992 |
| JP | 05-160972 | A | 6/1993 |
| JP | 10034945 | A | 2/1998 |
| JP | 2001-277529 | A | 10/2001 |
| JP | 2001-517159 | | 10/2001 |
| WO | WO 00/27640 | A1 | 5/2000 |
| WO | WO 00/71347 | A | 11/2000 |

* cited by examiner

CAPPING DEVICE FOR HAND-HELD PRINTER

CROSS REFERENCES TO RELATED APPLICATIONS

The present application is a Continuation of U.S. application Ser. No. 12/478,731 filed on Jun. 4, 2009, which is a Continuation of U.S. application Ser. No. 11/583,870 filed on Oct. 20, 2006, now issued U.S. Pat. No. 7,556,371 which is a Continuation of U.S. application Ser. No. 10/503,887 filed on Aug. 09, 2004, now issued U.S. Pat. No. 7,144,107, which is a 371 of PCT/AU03/00151 filed on Feb. 12, 2003, all of which are herein incorporated by reference.

FIELD OF THE INVENTION

The following invention relates to improvements in portable printer technology. More particularly, though not exclusively, the invention relates to a capping device for a hand-held drop-on-demand printer having a fixed printhead for ejecting droplets of ink onto a sheet of print media external to the printer.

BACKGROUND

Prior art drop-on-demand printers incorporate a supply of print media and employ a print media feed mechanism to transport the print media past the printhead or printheads to effect printing onto the print media. An application entitled "Manually Moveable Printer with Speed Sensor" discloses a portable, hand-held drop-on-demand inkjet printer having a fixed printhead. The printer can print an image onto a sheet external to the printer by passing the casing of the printer over and across the print media as the nozzles of the printhead eject ink.

During non-use periods of the printer, a capping device seals the printhead from the surrounding atmosphere to prevent evaporation of ink and the consequential blockage of the nozzles.

The present application is directed to specific capping arrangements for portable printers.

RELATED PATENT APPLICATIONS AND PATENTS

| | | | | |
|---|---|---|---|---|
| 6566858 | 6331946 | 6246970 | 6442525 | PCT/AU01/00141 |
| 7685423 | PCT/AU01/00139 | 6816968 | 6757832 | PCT/AU01/00140 |
| PCT/AU00/00741 | 6238044 | PCT/AU00/00742 | 6425661 | 6227652 |
| 6213588 | 6213589 | 6231163 | 6247795 | 6394581 |
| 6244691 | 6257704 | 6416168 | 6220694 | 6257705 |
| 6247794 | 6234610 | 6247793 | 6264306 | 6241342 |
| 6247792 | 6264307 | 6254220 | 6234611 | 6302528 |
| 6283582 | 6239821 | 6338547 | 6247796 | 6557977 |
| 6390603 | 6362843 | 6293653 | 6312107 | 6227653 |
| 6234609 | 6238040 | 6188415 | 6227654 | 6209989 |
| 6247791 | 6336710 | 6217153 | 6416167 | 6243113 |
| 6283581 | 6247790 | 6260953 | 6267469 | 6273544 |
| 6309048 | 6420196 | 6443558 | 6439689 | 6378989 |
| 6848181 | 6634735 | PCT/AU98/00550 | PCT/AU00/00095 | 6390605 |
| 6322195 | 6612110 | 6480089 | 6460778 | 6305788 |
| PCT/AU00/00172 | 6426014 | PCT/AU00/00338 | 6364453 | PCT/AU00/00339 |
| 6457795 | PCT/AU00/00581 | 6315399 | PCT/AU00/00580 | 6338548 |
| PCT/AU00/00582 | 6540319 | PCT/AU00/00587 | 6328431 | PCT/AU00/00588 |
| 6328425 | PCT/AU00/00589 | 6991320 | PCT/AU00/00341 | 6595624 |
| PCT/AU00/00340 | PCT/AU00/00749 | 6417757 | PCT/AU01/01332 | 7095309 |
| PCT/AU01/01318 | 6854825 | PCT/AU00/00750 | 7075677 | PCT/AU00/00751 |
| 6428139 | PCT/AU00/00752 | 6575549 | PCT/AU01/00502 | PCT/AU00/00583 |
| 6383833 | PCT/AU02/01120 | PCT/AU00/00593 | 6464332 | PCT/AU00/00333 |
| PCT/AU00/01513 | 6428142 | PCT/AU00/00590 | 6390591 | PCT/AU00/00591 |
| 7018016 | PCT/AU00/00592 | 6328417 | PCT/AU00/00584 | 6322194 |
| PCT/AU00/00585 | 6382779 | PCT/AU00/00586 | 6629745 | PCT/AU00/01514 |
| 6565193 | PCT/AU00/01515 | 6609786 | PCT/AU00/01516 | 6609787 |
| PCT/AU00/01517 | 6439908 | PCT/AU00/01512 | 6684503 | PCT/AU00/00753 |
| 6755513 | PCT/AU00/00594 | 6409323 | PCT/AU00/00595 | 6281912 |
| PCT/AU00/00596 | 6604810 | PCT/AU00/00597 | 6318920 | PCT/AU00/00598 |
| 6488422 | PCT/AU01/01321 | 6655786 | PCT/AU01/01322 | 6457810 |
| PCT/AU01/01323 | 6485135 | PCT/AU00/00516 | 6795215 | PCT/AU00/00517 |
| 7154638 | PCT/AU00/00511 | 6859289 | PCT/AU00/00754 | 6977751 |
| PCT/AU00/00755 | 6398332 | PCT/AU00/00756 | 6394573 | PCT/AU00/00757 |
| 6622923 | | | | |

DISCLOSURE OF THE INVENTION

According to an aspect of the present invention there is provided handheld inkjet printer comprising:

a housing;

a printhead fixedly mounted in the housing; and a capping device mounted external to the housing, the capping device comprising an arm, a capping leg extending transversely from the arm and an elastomeric pad affixed to the capping leg and in capping engagement with the printhead, the arm having a resilient portion deformable towards the housing upon receipt of a force, the housing defining a fulcrum with the arm and the leg being positioned on opposite sides of the fulcrum, wherein deformation of the arm towards the housing causes displacement of the capping leg away from the housing and displacement of the elastomeric pad out of capping engagement with the printhead.

Other aspects are also provided.

BRIEF DESCRIPTION OF THE DRAWINGS

Preferred forms of the present invention will now be described by way of example only with reference to the accompanying drawings wherein.

DESCRIPTION OF THE PREFERRED EMBODIMENTS

In the accompanying drawings there are schematically depicted a number of different capping configurations for a portable printer. The portable printer is intended to eject droplets of ink onto a sheet of print media as the printer is held by hand and moved across the sheet of print media. A typical internal configuration of a printhead and associated hardware in a portable printer for which the capping devices disclosed herein are applicable is disclosed in co-pending application entitled "Manually Moveable Printer with Speed Sensor" (AP43).

Figure 1:
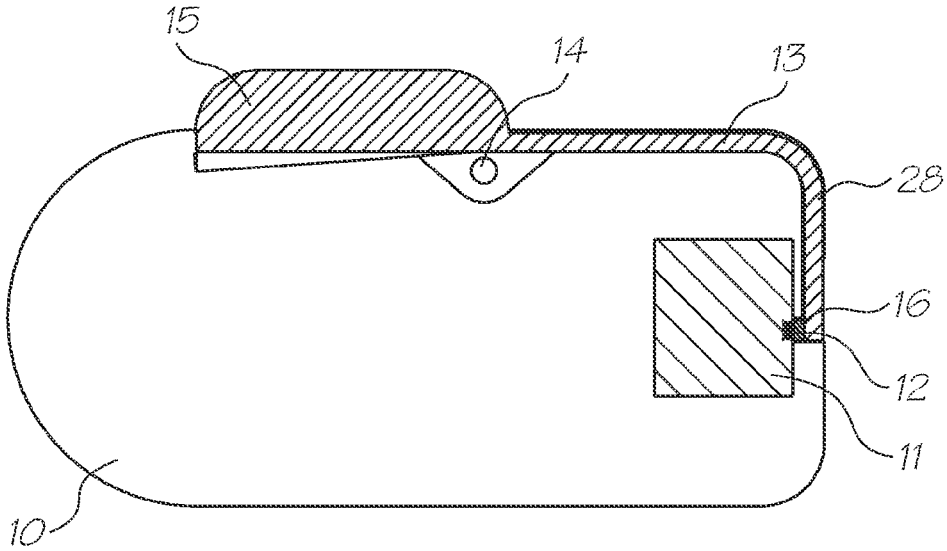
FIG. 1 is a schematic cross-sectional end elevational view of a portable printer showing a first capping device in a capped position.
Figure 2:
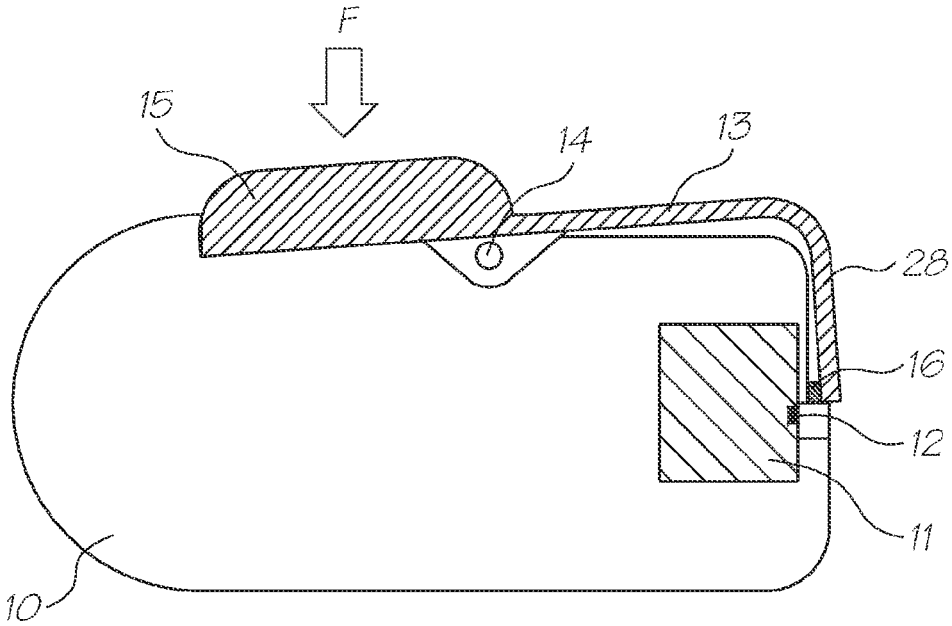
FIG. 2 is a schematic cross-sectional end elevational view of the portable printer of FIG. 1 with the first capping device shown in an uncapped position.

In FIGS. 1 and 2 of the accompanying drawings there is schematically depicted in cross-section, a printer housing 10 having located therein a fixed printhead 11. The printhead 11 has a print chip 12 extending throughout its full width, that is, the width of an image to be printed. A first embodiment of a capper arm 13, which may be metallic or formed of other material such as plastics, is pivotally mounted at 14 to the printer housing 10. The capper arm 13 resides at the exterior of the housing 10 and includes a leg 28 to which there is affixed an elastomeric pad 16 which seals against the chip 12 in the capped configuration depicted in FIG. 1. The elastomeric pad 16 is moved away from the print chip 12 by leg 28 to enable printing in the configuration depicted in FIG. 2.

The capper arm 13 includes an activating region 15 to which finger force can be applied as indicated by arrow F shown in FIG. 2. The application of such finger force causes pivoting of the capper arm 13 about pivot 14. A spring (not shown) can return the capper arm to the position shown in FIG. 1.

Figure 3:
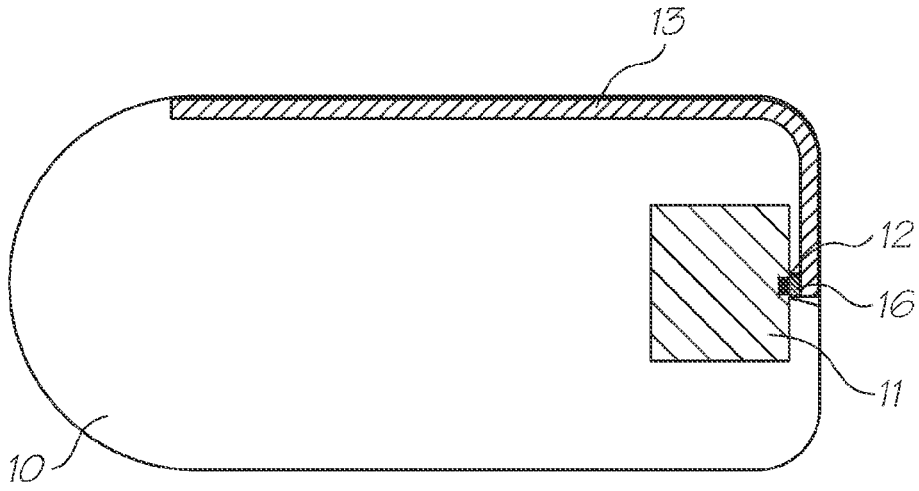
FIG. 3 is a schematic cross-sectional end elevational view of a portable printer having a second type of capping device, in a capped position.
Figure 4:
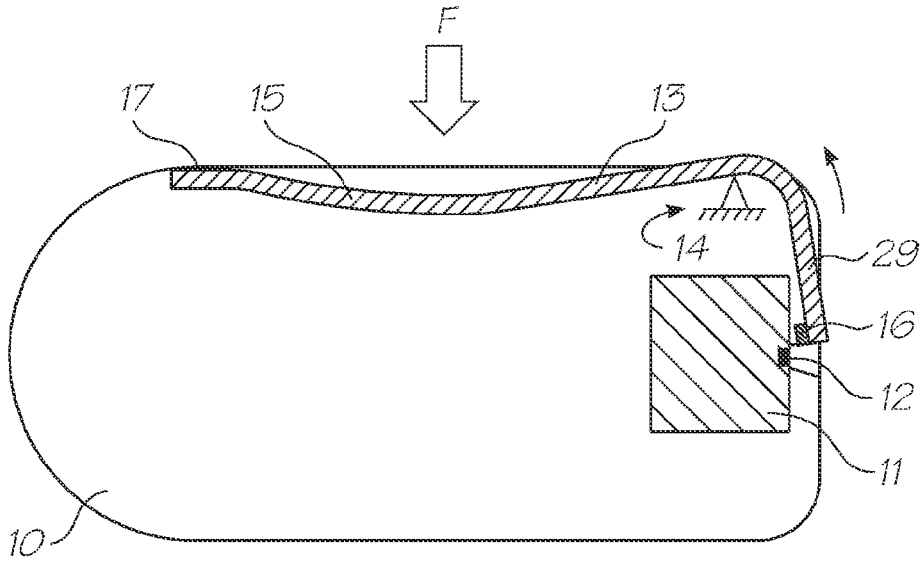
FIG. 4 is a schematic cross-sectional end elevational view of the printer of FIG. 3 with the second capping device, in an uncapped position.

A second embodiment of the capping device is depicted in FIGS. 3 and 4. In this embodiment, the capper arm 13 is formed of a resilient, elastically deformable material such as metal or plastics. In a particular preferred embodiment, the capper arm 13 is formed of stainless steel. The capper arm 13 is fixed at 17 to the printer housing 10 at one end thereof. A fulcrum 14 (depicted schematically) resides alongside the transition of the capper arm 13 to the leg 29.

Upon the application of finger force F as indicated in FIG. 4, the capper arm 13 deforms, resulting in the leg 29 moving to the position depicted in FIG. 4 so as to draw the elastomeric pad 16 away from the print chip 12 for printing purposes. Upon release of the finger force F, the resilience of the capper returns it to the configuration depicted in FIG. 3 wherein the elastomeric pad 16 seals against the print chip 12.

In the first and second embodiments of the capping device shown in FIGS. 1 to 4, a user grasps the printer housing 10 and in doing so, inherently applies a force F to the activation region 15 of the capper arm 13. There may be provided a switch within the printer housing and associated with the capper arm 13 such that application of finger force F depresses the switch to set the printhead 11 into a printing operational mode.

Figure 5:
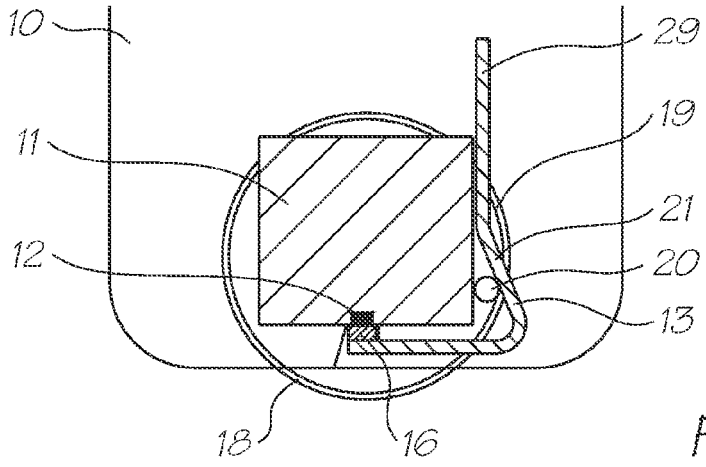
FIG. 5 is a schematic cross-sectional end elevational view of a portion of another printer having a third type of capping device, in a capped position.
Figure 6:
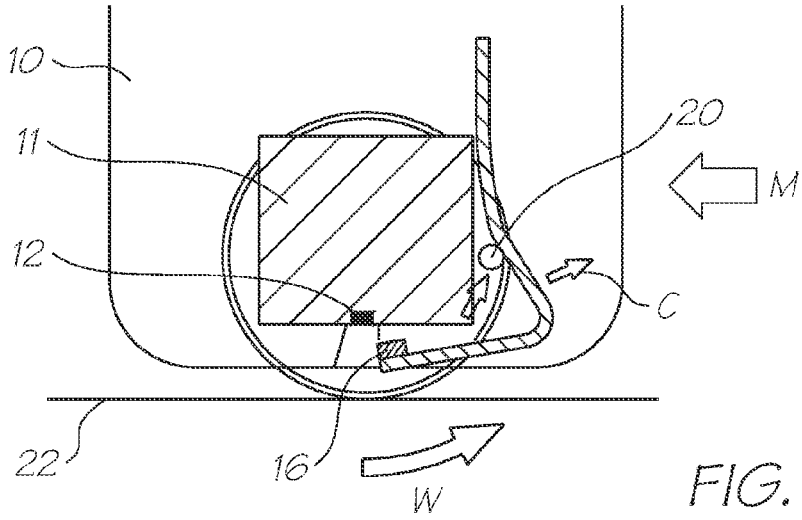
FIG. 6 is a schematic cross-sectional elevational view of a portion of the printer of FIG. 5 with the third capping device in an uncapped position.
Figure 7:
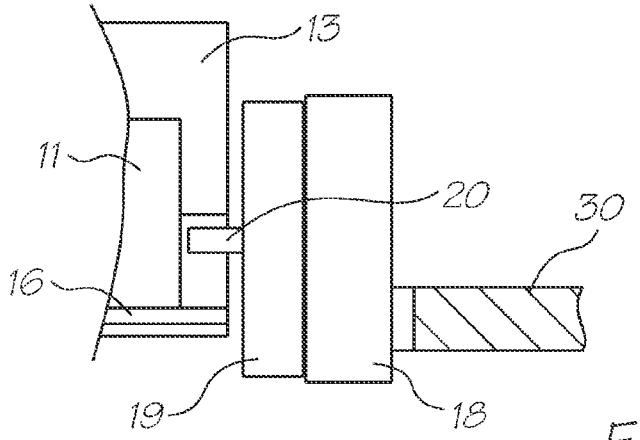
FIG. 7 is a schematic front elevational view of a friction clutch used in the embodiment of FIGS. 5 and 6.

In FIGS. 5 to 7 of the accompanying drawings there is schematically depicted a third embodiment of a capping device incorporating a friction clutch. In this embodiment, the printer housing 10 has mounted thereto one or more wheels 18, at least one of which can be associated with an optical sensor as described in the cross-referenced application AP43 entitled "Manually Moveable Printer with Speed Sensor". One of the wheels, ie. wheel 18 in this example, can have associated with it a friction clutch 19. Wheel 18 and clutch 19 can be mounted upon a common shaft 30 (FIG. 7) and biased against each other such that rotation of wheel 18 causes rotation of clutch 19 until something stops the clutch 19 from spinning, whereupon wheel 18 continues to rotate with a dynamic frictional engagement between it and the non-rotating clutch 19. In the embodiment depicted, the friction clutch 19 has a peg 20 extending laterally from it. This peg 20 is received behind a deviated portion 21 of the capper arm 13. In this embodiment, the capper arm 13 is attached within the printer housing 10 such that portion 29 moves in a linear fashion, ie. it is guided to move in a straight line. Upon rotation of friction clutch 19, the peg 20 bears against the deviated portion 21 of capper arm 13 to move it in the direction indicated by arrow C (FIG. 6). This, in turn, draws the elastomeric pad 16 away from the chip 12. It should be appreciated in this regard that wheel 18 is riding upon the print media 22 to effect wheel rotation in the direction indicated by arrow W in FIG. 6. When the printer housing 10 is lifted away from the print media 22, rotation W ceases, whereupon resilience of the capper arm 13 pushes the peg 20 back to the position depicted at FIG. 5 and at the same time returns the elastomeric pad 16 to seal the print chip 12 as shown in FIG. 5.

Figure 8:
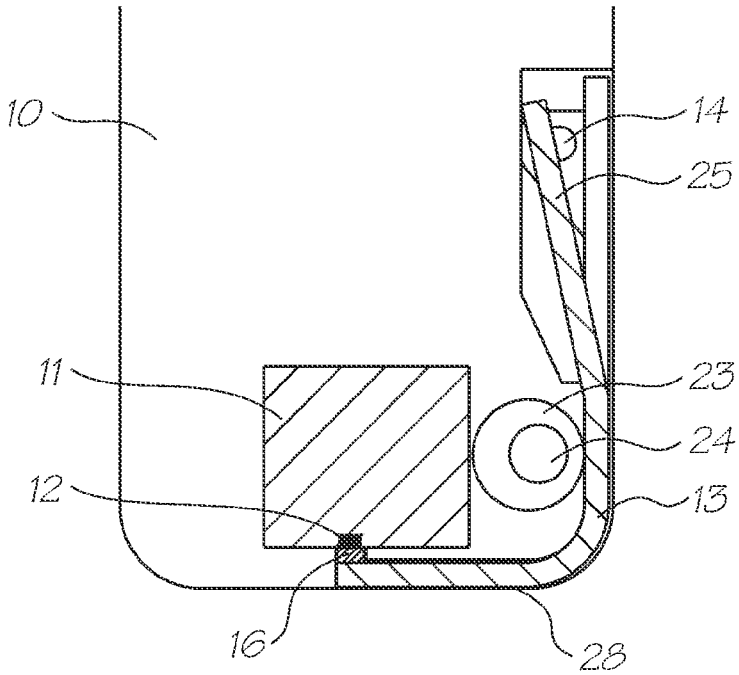
FIG. 8 is a schematic cross-sectional end elevational view of a portion of a printer having a fourth type of capping device, in a capped position.
Figure 9:
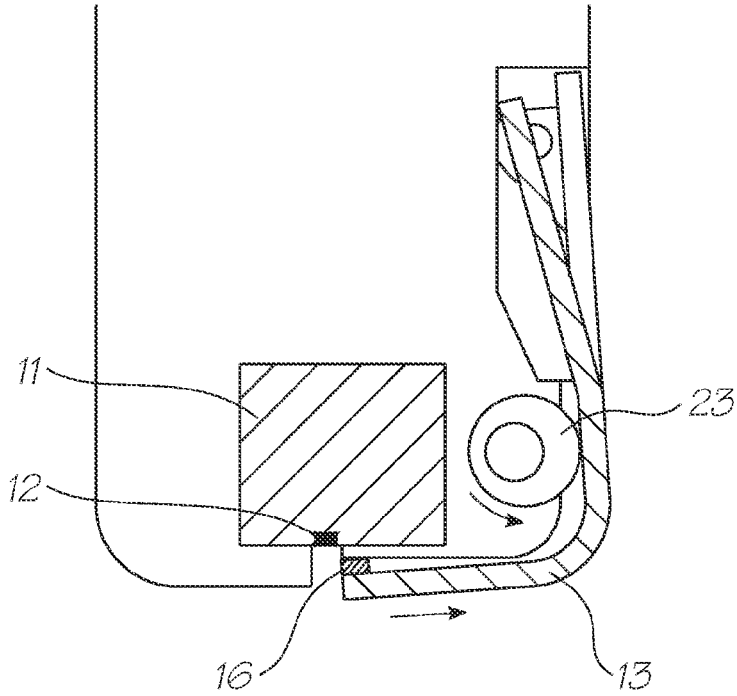
FIG. 9 is a schematic cross-sectional end elevational view of a portion of the printer of FIG. 8 with the fourth capping device shown in an uncapped configuration.

In a fourth embodiment of the capping device shown in FIGS. 8 and 9, there is provided an internally driven camshaft 24 including an eccentric cam 23. Camshaft 24 might be selectively rotated by means of an electric motor for example. In this embodiment, the capper arm 13 is mounted to a pivot 14 and is biased by an integral spring 25 against the eccentric cam 23. That is, the integral spring 25 biases the leg portion 28 of the capper arm 13 to the position depicted in FIG. 8 whereat the elastomeric pad 16 seals over chip 12. When the camshaft

24 is rotated such that the eccentric cam rotates into the position depicted in FIG. 9, the capper arm 13 deforms integral spring 25 while the elastomeric pad 16 moves away from the print chip 12.

Figure 10:
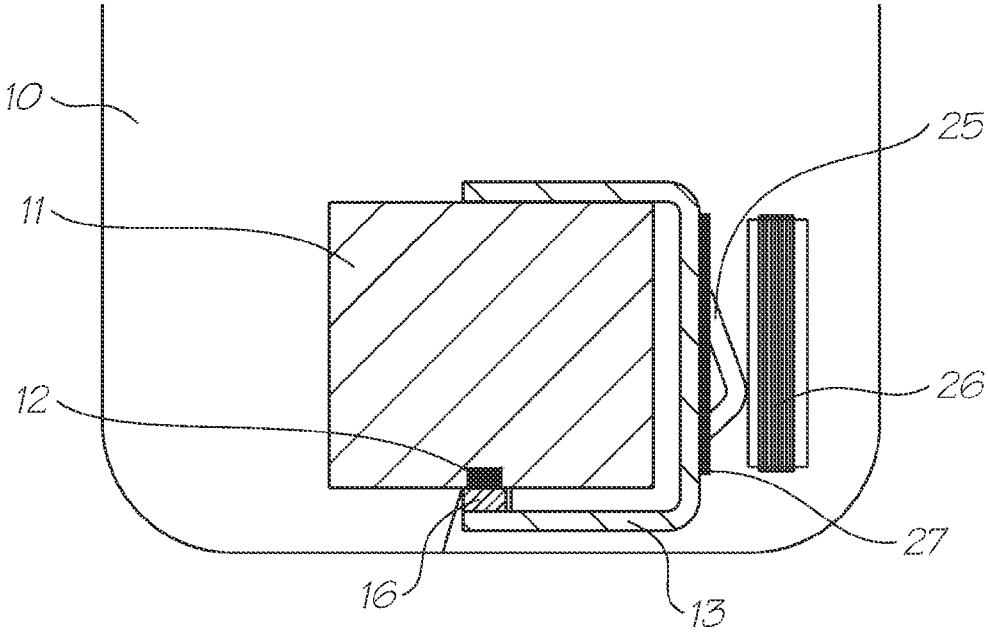
FIG. 10 is a schematic cross-sectional end elevational view of a portion of a printer having a fifth type of capping device, in a capped configuration.
Figure 11:
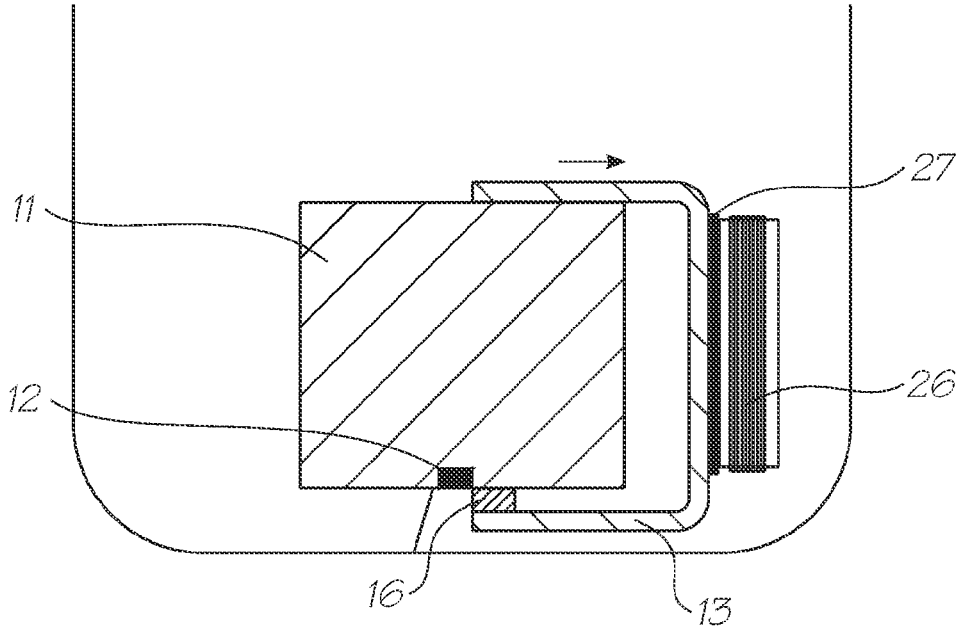
FIG. 11 is a schematic cross-sectional end elevational view of the portion of the printer of FIG. 10 with the fifth capping device shown in an uncapped configuration.

In FIGS. 10 and 11 of the accompanying drawings, there is depicted a fifth embodiment of the capping device wherein the capper arm 13 is activated by an internal solenoid 26. In this embodiment, the capper arm 13 slides linearly between the positions depicted in FIGS. 10 and 11. The capper arm 13 includes an integral spring 25 that bears against solenoid 26. As an alternative, the spring 25 could bear against some other fixed internal structure of the printer housing 10. Attached to the capper arm 13 is a metallic plate 27 to be attracted to the solenoid 26 by magnetic interaction therewith. Application of electric current to the solenoid 26 creates a magnetic field drawing the metal plate 27 thereto. This in turn draws the capper 13 to the uncapped position where the elastomeric pad 16 has moved away from the print chip 12 to enable printing to commence.

When the solenoid is no longer receiving electric current, its magnetic field diminishes or ceases enabling the spring 28 to return the capper arm 13 to the capped position depicted in FIG. 10.

It should be appreciated that modifications and alterations obvious to those skilled in the art are not to be considered as beyond the scope of the present invention. For example, the elastomeric pad need not be affixed to the capper arm itself. Instead, it might be attached to the printhead 11 so as to surround the print chip 12 and come into sealing contact with a smooth surface of leg 28 of capper arm 13.

I claim:

1. A handheld inkjet printer comprising:

a housing;

a printhead fixedly mounted in the housing; and a capping device mounted external to the housing, the capping device comprising an arm, a capping leg extending transversely from the arm and an elastomeric pad affixed to the capping leg and in capping engagement with the printhead, the arm having a resilient portion deformable towards the housing upon receipt of a force, the housing defining a fulcrum with the arm and the leg being positioned on opposite sides of the fulcrum, wherein deformation of the arm towards the housing causes displacement of the capping leg away from the housing and displacement of the elastomeric pad out of capping engagement with the printhead.

2. An inkjet printer as claimed in claim 1, wherein the housing defines a recess which receives the resilient portion of the arm during deformation.

3. An inkjet printer as claimed in claim 1, wherein the force is applied by user's finger.

4. An inkjet printer as claimed in claim 1, wherein the printhead ejects ink towards a surface located external to the housing.

* * * * *